US008387709B2

(12) United States Patent
Kriesels

(10) Patent No.: US 8,387,709 B2
(45) Date of Patent: Mar. 5, 2013

(54) METHOD OF EXPANDING A TUBULAR ELEMENT IN A WELLBORE

(75) Inventor: Petrus Cornelis Kriesels, Rijswijk (NL)

(73) Assignee: Shell Oil Company, Houston, TX (US)

( * ) Notice: Subject to any disclaimer, the term of this patent is extended or adjusted under 35 U.S.C. 154(b) by 277 days.

(21) Appl. No.: 12/746,995

(22) PCT Filed: Dec. 11, 2008

(86) PCT No.: PCT/EP2008/067301
§ 371 (c)(1),
(2), (4) Date: Jun. 9, 2010

(87) PCT Pub. No.: WO2009/074639
PCT Pub. Date: Jun. 18, 2009

(65) Prior Publication Data

US 2010/0270036 A1 Oct. 28, 2010

(30) Foreign Application Priority Data

Dec. 13, 2007 (EP) ..... 07123098

(51) Int. Cl.
*E21B 19/00* (2006.01)

(52) U.S. Cl. ..... 166/384; 166/207; 405/146

(58) Field of Classification Search ..... 166/384, 166/242.2, 207; 405/150.1, 184, 165, 146; 175/171, 78, 52
See application file for complete search history.

(56) References Cited

U.S. PATENT DOCUMENTS

| | | | | |
|---|---|---|---|---|
| 4,501,337 | A | 2/1985 | Dickinson, III et al. | 175/171 |
| 6,109,828 | A * | 8/2000 | Keller | 405/146 |
| 7,150,328 | B2 | 12/2006 | Marketz et al. | 166/380 |
| 7,464,774 | B2 | 12/2008 | Savignat et al. | 175/385 |
| 7,946,349 | B2 | 5/2011 | Kriesels | 166/384 |
| 8,056,641 | B2 | 11/2011 | Kriesels et al. | 166/384 |
| 8,056,642 | B2 | 11/2011 | Kriesels et al. | 166/384 |
| 8,141,647 | B2 | 3/2012 | Kriesels et al. | 166/380 |
| 2010/0089593 | A1 | 4/2010 | Hou | 166/384 |
| 2010/0243275 | A1 | 9/2010 | Kriesels | 166/384 |
| 2010/0252333 | A1 | 10/2010 | Blange et al. | 175/424 |
| 2010/0263878 | A1 | 10/2010 | Van Nieuwkoop | 166/384 |
| 2010/0270037 | A1 | 10/2010 | Kriesels et al. | 166/384 |
| 2010/0276157 | A1 | 11/2010 | Kriesels | 166/381 |
| 2010/0276202 | A1 | 11/2010 | Kriesels | 175/61 |
| 2010/0294487 | A1 | 11/2010 | Kriesels | 166/207 |
| 2011/0266007 | A1 | 11/2011 | Hou | 166/384 |
| 2011/0278009 | A1 | 11/2011 | Elliott et al. | 166/307 |

FOREIGN PATENT DOCUMENTS

| | | |
|---|---|---|
| DE | 1189492 | 3/1965 |
| EP | 0044706 | 1/1982 |

(Continued)

*Primary Examiner* — Shane Bomar
*Assistant Examiner* — Kipp Wallace

(57) ABSTRACT

A method for radially expanding a tubular element in a wellbore formed in an earth formation comprises arranging the tubular element in the wellbore such that a lower end portion of the wall of the tubular element extends radially outward and in an axially reverse direction so as to define an expanded tubular section extending around a remaining tubular section of the tubular element, and axially extending the expanded tubular section by moving the remaining tubular section a selected distance downward relative to the expanded tubular section so that said lower end portion of the wall bends radially outward and in an axially reverse direction. The remaining tubular section is axially extended at an upper end thereof with an extended tubular portion of a length at least equal to said distance of downward movement of the remaining tubular section.

16 Claims, 8 Drawing Sheets

FOREIGN PATENT DOCUMENTS

| | | |
|---|---|---|
| EP | 0611914 | 8/1994 |
| WO | WO9822690 | 5/1998 |
| WO | WO03036025 | 5/2003 |
| WO | WO2005024178 | 3/2005 |

* cited by examiner

METHOD OF EXPANDING A TUBULAR ELEMENT IN A WELLBORE

PRIORITY CLAIM

The present application claims priority to PCT Application EP2008/067301, filed 11 Dec. 2008, which claims priority to European Patent Application No. EP 07123098.1, filed 13 Dec. 2007.

TECHNICAL FIELD OF THE INVENTION

The present invention relates to a method of radially expanding a tubular element in a wellbore formed into an earth formation.

BACKGROUND OF THE INVENTION

The technology of radially expanding tubular elements in wellbores finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a certain depth further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a system for expanding a tubular element in a wellbore whereby the tubular element, in unexpanded state, is initially attached to a drill string during drilling of a new wellbore section.

To expand such wellbore tubular element, generally a conical expander is used with a largest outer diameter substantially equal to the required tubular diameter after expansion. The expander is pumped, pushed or pulled through the tubular element. Such method can lead to high friction forces between the expander and the tubular element. Also, there is a risk that the expander becomes stuck in the tubular element.

EP 0044706 A2 discloses a flexible tube of woven material or cloth that is expanded in a wellbore by eversion to separate drilling fluid pumped into the wellbore from slurry cuttings flowing towards the surface.

However there is a need for an improved method of radially expanding a tubular element in a wellbore.

SUMMARY OF THE INVENTION

In accordance with the invention there is provided a method of radially expanding a tubular element in a wellbore formed in an earth formation, the method comprising:

arranging the tubular element in the wellbore whereby a lower end portion of the wall of the tubular element extends radially outward and in axially reverse direction so as to define an expanded tubular section extending around a remaining tubular section of the tubular element;

axially extending the expanded tubular section by moving the remaining tubular section a selected distance downward relative to the expanded tubular section so that said lower end portion of the wall bends radially outward and in axially reverse direction;

axially extending the remaining tubular section at an upper end thereof with an extended tubular portion of a length at least equal to said distance of downward movement of the remaining tubular section.

By moving the remaining tubular section downward relative to the expanded tubular section, the tubular element is effectively turned inside out whereby the tubular element is progressively expanded without the need for an expander that is pushed, pulled or pumped through the tubular element. The expanded tubular section can form a casing or liner in the wellbore.

Furthermore, the remaining tubular section gradually shortens at its lower end due to continued reverse bending of the wall. Therefore, by extending the remaining tubular section at its upper end to compensate for shortening at its lower end, the process of reverse bending of the wall can be continued until the expanded tubular section reaches a desired length.

In an advantage application, a conduit extends into the remaining tubular section, wherein the extended tubular portion is assembled around conduit. In this manner, the remaining tubular section can be extended at its upper end without needing to remove the conduit.

Suitably the extended tubular portion is formed from first and second wall sections axially displaced from each other, and a third wall section axially overlapping with said first and second wall sections. It is thus achieved that the connection between the first and second wall sections does not extend the full circumference of the remaining tubular section. This has the advantage that, in case of damage to the connection between the first and second wall sections during the eversion process, such damage does not propagate along the full circumference of the remaining tubular section.

In a preferred application, said first and second wall sections are comprised in a primary row of wall sections, and said third wall section is comprised in a secondary row of wall sections, said rows being staggered in axial direction relative to each other.

To further reduce the risk of propagating damage in circumferential direction during eversion, the first and second wall sections suitably are interconnected at a connection extending inclined relative to a central longitudinal axis of the remaining tubular section.

In case a body of fluid is located in the remaining tubular section, suitably a fluid conduit extends from the body of fluid to a location above the remaining tubular section, whereby the fluid conduit is movable in upward direction relative to the remaining tubular section. By moving the fluid conduit upwardly in correspondence with extension of the remaining tubular section at its upper end, fluid communication can be maintained with the body of fluid in the wellbore via the fluid conduit.

In a preferred embodiment the conduit is a drill string for further drilling of the wellbore. Suitably the drill string is operated to further drill the wellbore, wherein the remaining tubular section and the drill string are simultaneously lowered through the wellbore.

To achieve that the expanded tubular section retains its expanded form, it is preferred that the wall of the tubular element includes a material that is plastically deformed in the bending zone, so that the expanded tubular section automatically remains expanded as a result of said plastic deformation. Plastic deformation refers in this respect to permanent deformation, as occurring during deformation of various ductile metals upon exceeding the yield strength of the material. Thus, there is no need for an external force or pressure to maintain the expanded form. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars.

In order to induce said movement of the remaining tubular section, preferably the remaining tubular section is subjected to an axially compressive force acting to induce said movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

BRIEF DESCRIPTION OF THE DRAWINGS

The invention will be described hereinafter in more detail and by way of example, with reference to the accompanying drawings in which.

In the drawings and the description, like reference numerals relate to like components.

DETAILED DESCRIPTION OF THE PREFERRED EMBODIMENTS

Figure 1:
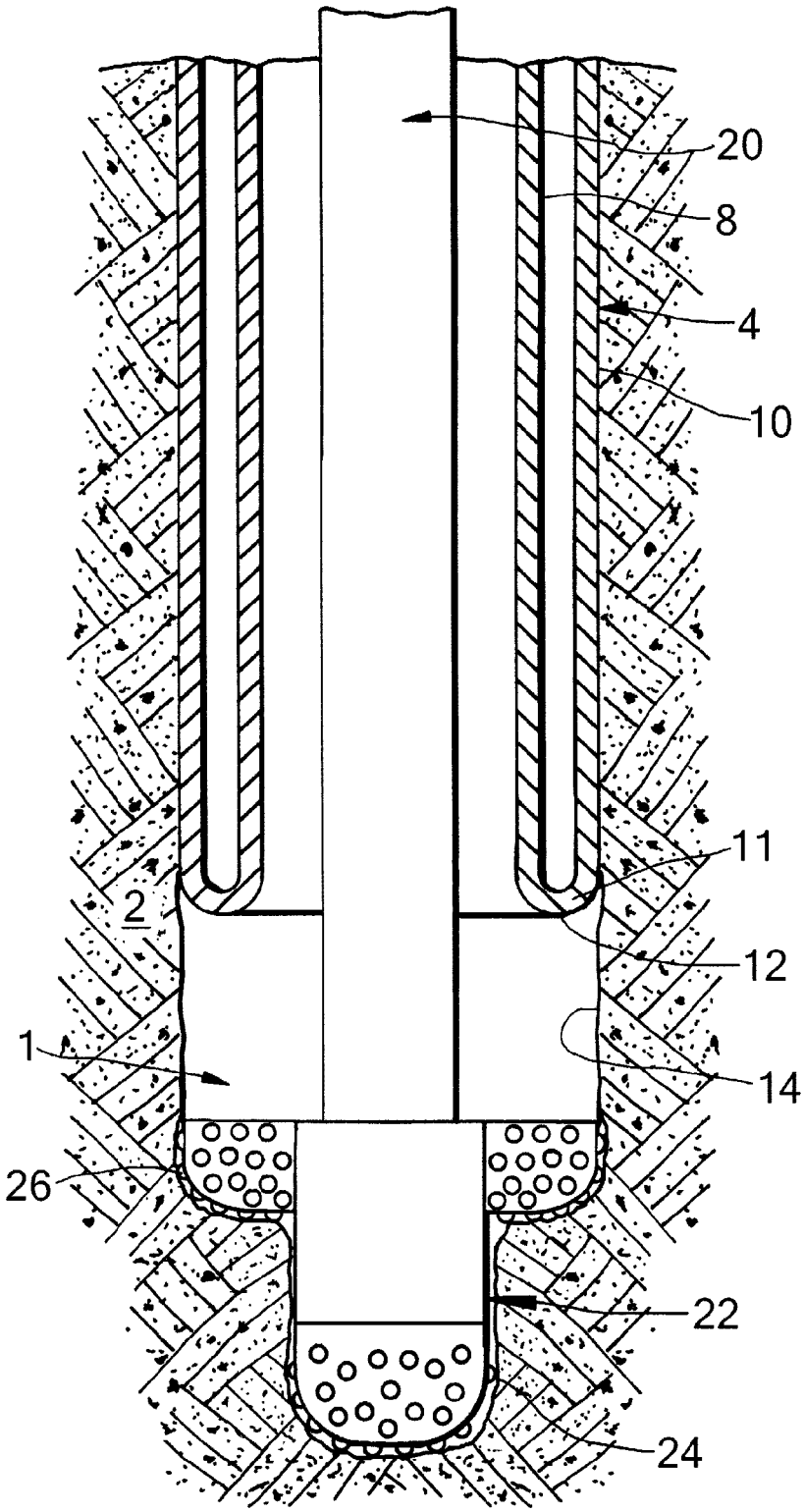
FIG. 1 schematically shows an embodiment of a lower portion of a wellbore system used with the method of the invention.

Referring to FIG. 1 there is shown a wellbore system including a wellbore 1 extending into an earth formation 2, and a tubular element in the form of liner 4 extending from surface downwardly into the wellbore 1. The liner 4 has been partially radially expanded by eversion of the wall of the liner whereby a radially expanded tubular section 10 of the liner 4 has been formed, which has an outer diameter substantially equal to the wellbore diameter. A remaining tubular section of the liner 4, in the form of unexpanded liner section 8, extends concentrically within the expanded tubular section 10.

The wall of the liner 4 is, due to eversion at its lower end, bent radially outward and in axially reverse (i.e. upward) direction so as to form a U-shaped lower section 11 of the liner interconnecting the unexpanded liner section 8 and the expanded liner section 10. The U-shaped lower section 11 of the liner 4 defines a bending zone 12 of the liner.

The expanded liner section 10 is axially fixed to the wellbore wall 14 by virtue of frictional forces between the expanded liner section 10 and the wellbore wall 14 resulting from the expansion process. Alternatively, or additionally, the expanded liner section 10 can be anchored to the wellbore wall by any suitable anchoring means (not shown).

A drill string 20 extends from surface through the unexpanded liner section 8 to the bottom of the wellbore 1. The drill string 20 is at its lower end provided with a drill bit 22 comprising a pilot bit 24 with gauge diameter slightly smaller than the internal diameter of the unexpanded liner section 8, and a reamer section 26 with gauge diameter adapted to drill the wellbore 1 to its nominal diameter. The reamer section 26 is radially retractable to an outer diameter allowing it to pass through unexpanded liner section 8, so that the drill string 20 can be retrieved through the unexpanded liner section 8 to surface. Reference sign 28 indicates a central longitudinal axis of unexpanded liner section 8.

Figure 2:
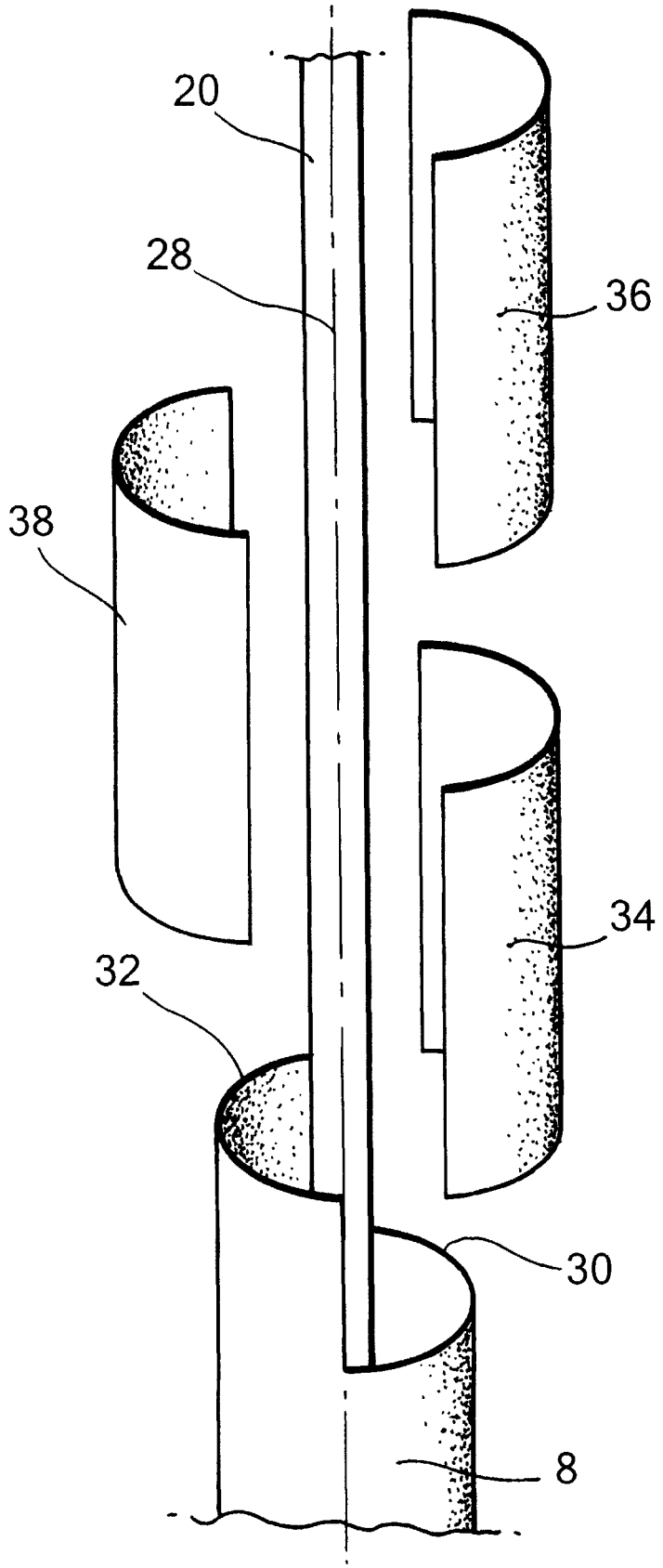
FIG. 2 schematically shows a first embodiment of an upper portion of the system of FIG. 1 during an initial stage of operation.
Figure 3:
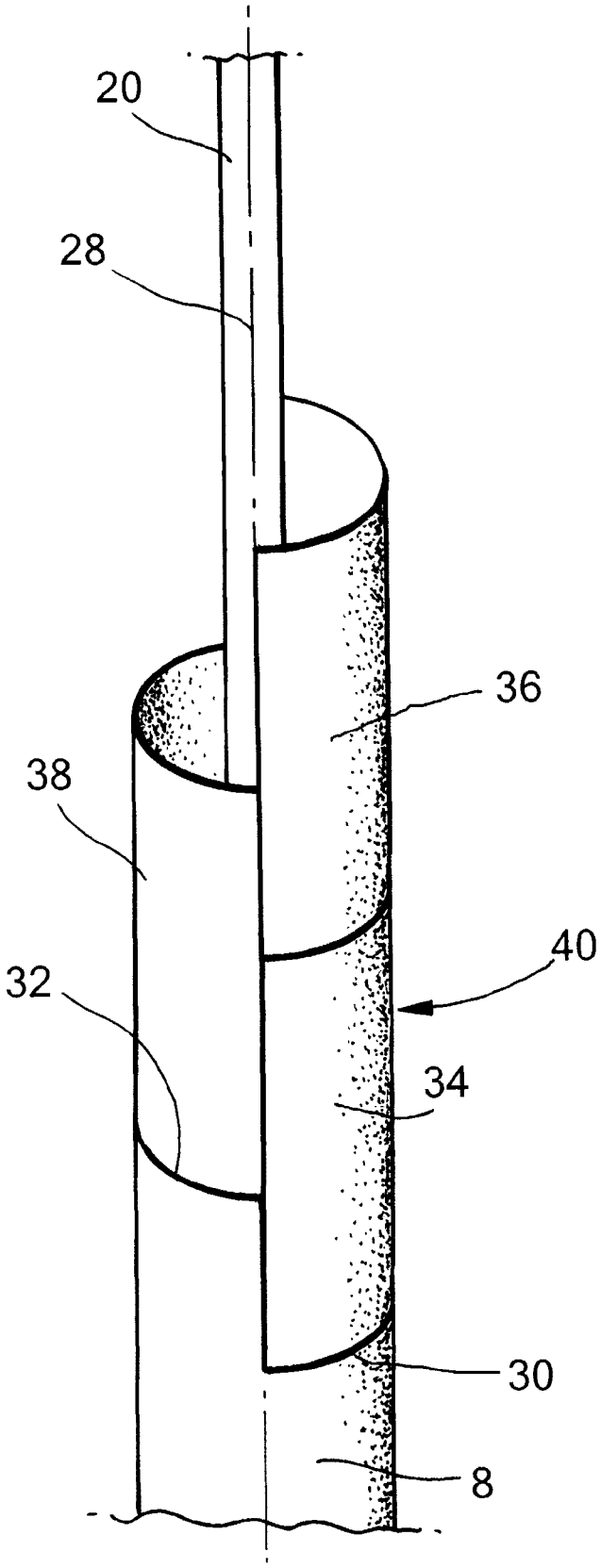
FIG. 3 schematically shows the first embodiment during a subsequent stage of operation.

FIGS. 2 and 3 show a first embodiment of an upper portion of the system of FIG. 1 whereby unexpanded liner section 8 (located at surface) has upper edges 30, 32. Each edge 30, 32 extends along a portion of the circumference of the unexpanded liner section 8, whereby edge 32 is upwardly displaced from edge 30. A first wall section 34, a second wall section 36 and a third wall section 38 are provided for assembly into an extended upper portion 40 (FIG. 3) of the remaining tubular section. The wall sections 34, 36, 38 are of hemispherical cross-sectional shape. FIG. 3 shows the extended upper portion 40 as assembled from the wall sections 34, 36, 38 and connected to the upper end of expanded liner section 8.

Figure 4:
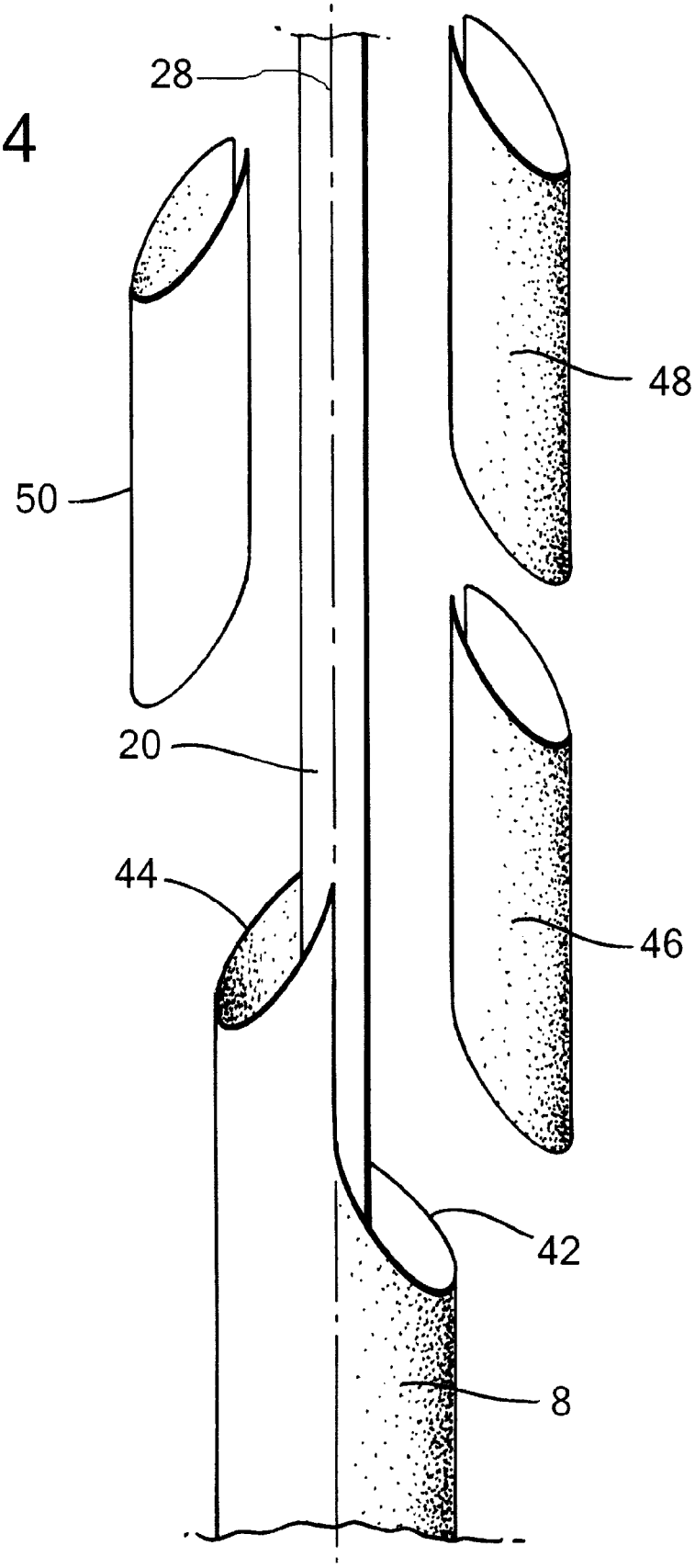
FIG. 4 schematically shows a second embodiment of an upper portion of the system of FIG. 1, during an initial stage of operation.
Figure 5:
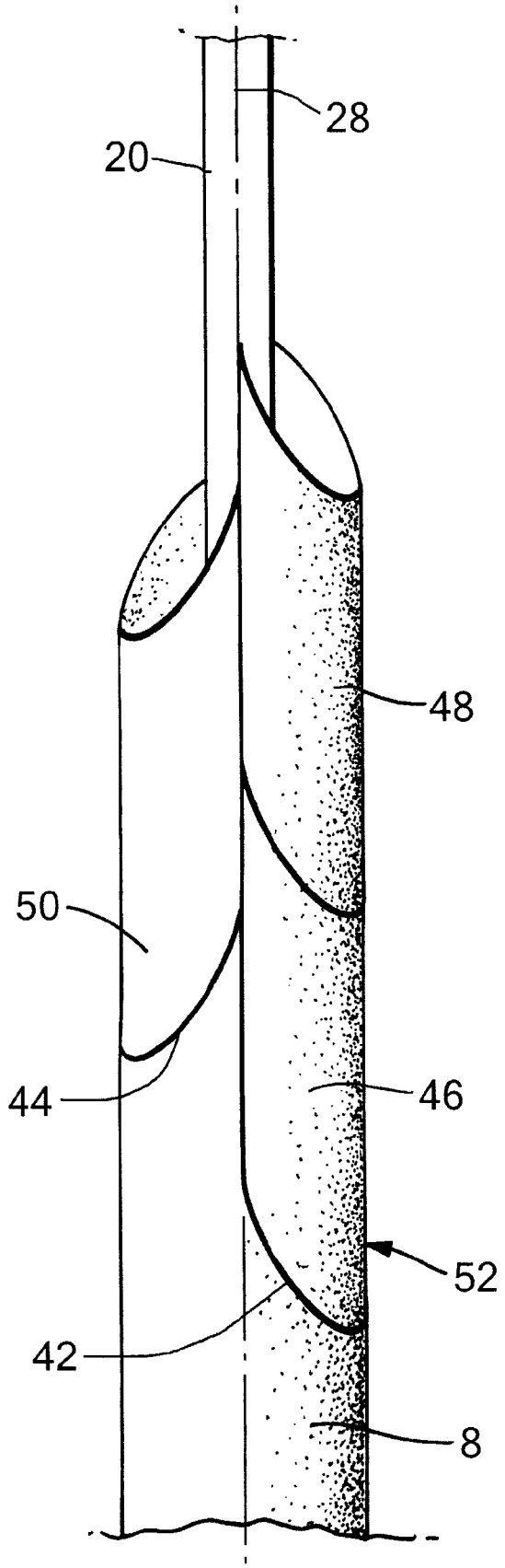
FIG. 5 schematically shows the second embodiment during a subsequent stage of operation.

FIGS. 4 and 5 show a second embodiment of an upper portion of the system of FIG. 1 whereby unexpanded liner section 8 (located at surface) has upper edges 42, 44. Each edge 42, 44 extends along a portion of the circumference of the unexpanded liner section 8, and inclined relative to the central longitudinal axis of liner section 8, whereby edge 44 is upwardly displaced from edge 42. A primary wall section 46, a secondary wall section 48 and a tertiary wall section 50 are provided for assembly into an extended upper portion 52 (FIG. 5) of the remaining tubular section. The wall sections 46, 48, 50 are of hemispherical cross-sectional shape. FIG. 5 shows the extended upper portion 52 after assembly from wall sections 46, 48, 50, and connected to the upper end of expanded liner section 8.

Figure 6:
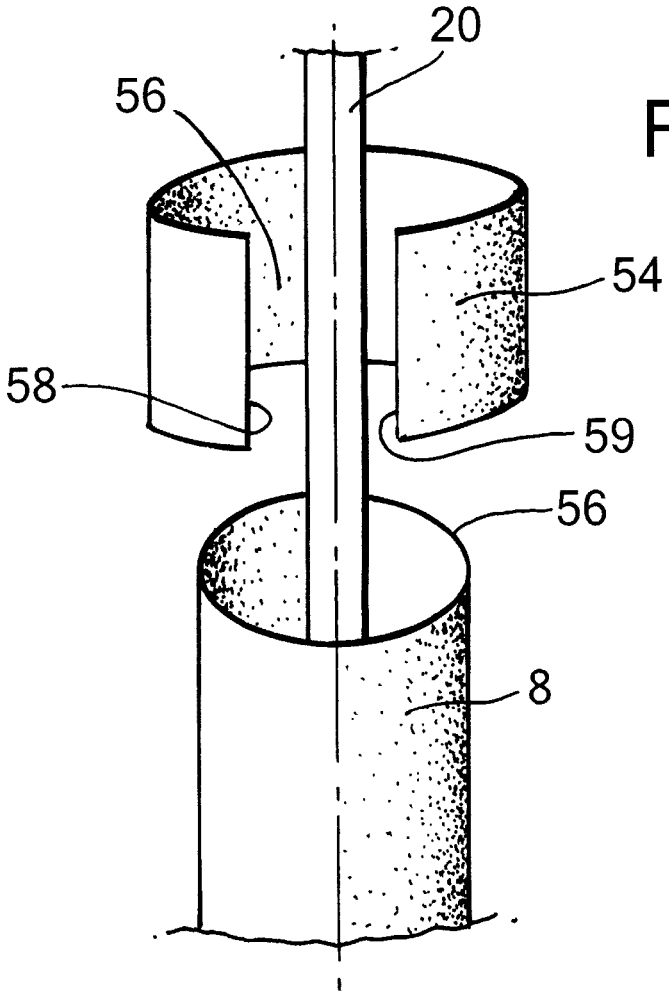
FIG. 6 schematically shows a third embodiment of an upper portion of the system of FIG. 1, during an initial stage of operation.
Figure 7:
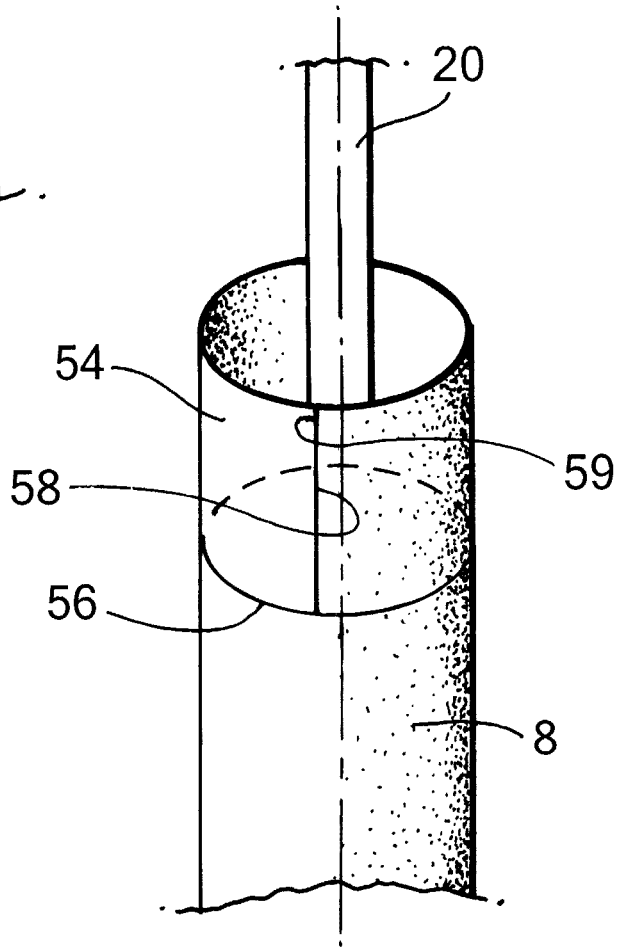
FIG. 7 schematically shows the third embodiment during a subsequent stage of operation.

FIGS. 6 and 7 show a third embodiment of an upper portion of the system of FIG. 1 whereby unexpanded liner section 8 (located at surface) has upper edge 56 extending continuously along the full circumference of unexpanded liner section 8. An extension member 54 is provided for extension of unexpanded liner section 8 at its upper end, the extension member 54 having a transverse opening 56 through which the drill string 20 can pass. The transverse opening 56 is defined between a pair of longitudinal edges 58, 59 of the extension member 54. The extension member 54 can be formed, for example, from a pipe section of the same diameter and wall thickness as the unexpanded liner section 8, cut in longitudinal direction to form the edges 58, 59. FIG. 7 shows the extension member 54 after the edges 58, 59 have been welded together, and after welding of extension member 54 to upper edge 56 of unexpanded liner section 8.

Figure 8C:
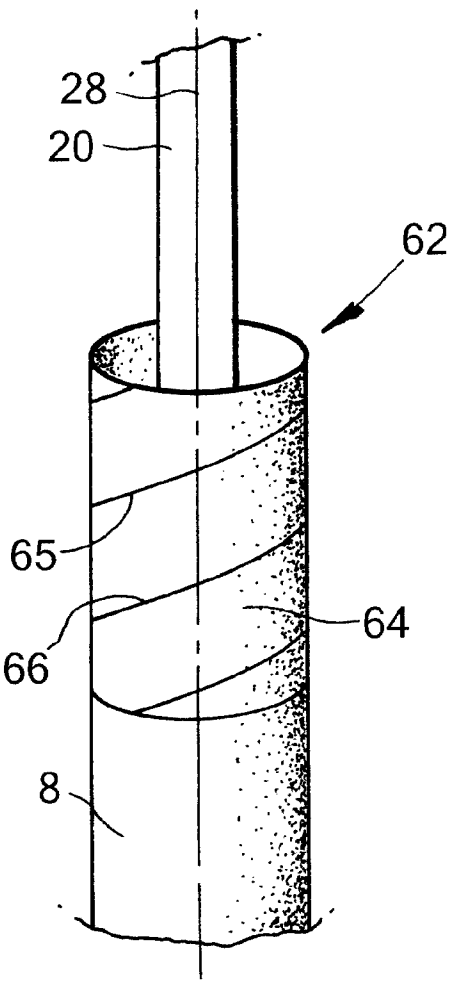
FIGS. 8A-C schematically show a fourth embodiment of an upper portion of the system of FIG. 1 at different stages of use.
Figure 8B:
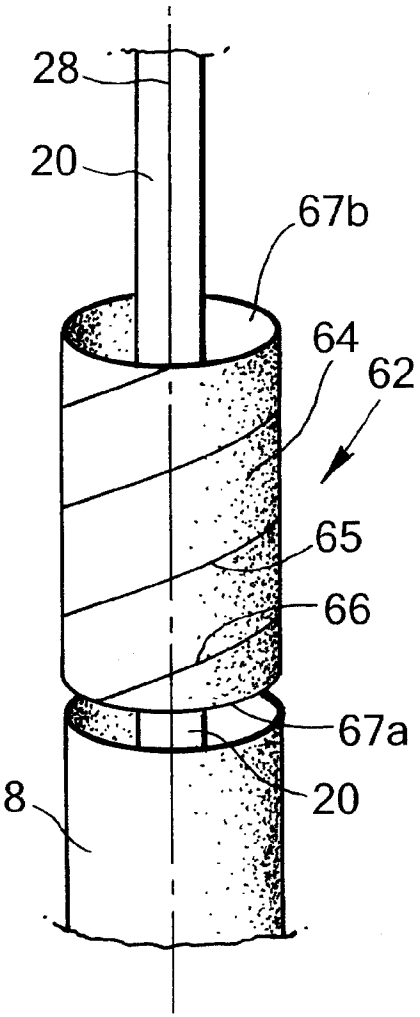
Figure 8A:
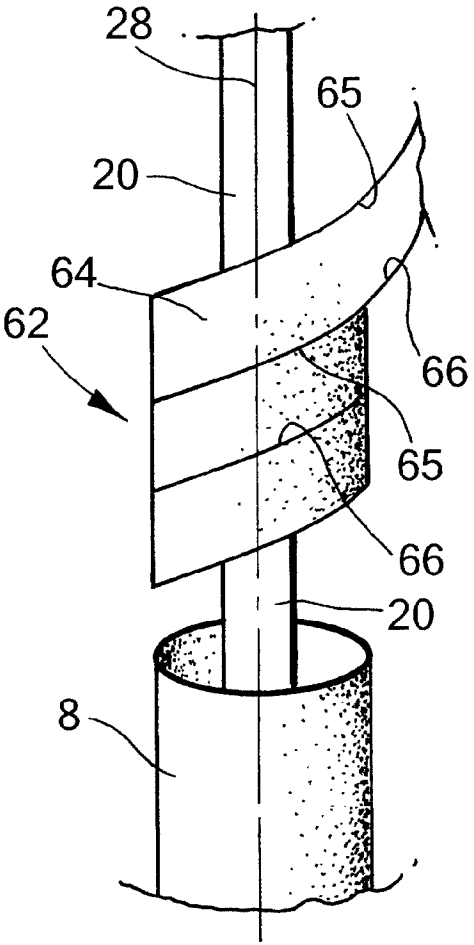

FIGS. 8A-C show a fourth embodiment of an upper portion of the system of FIG. 1, whereby unexpanded liner section 8 is at its upper end extended with an extended tubular portion 62 formed of a helically wound metal strip 64 having parallel edges 65, 66.

Figure 9:
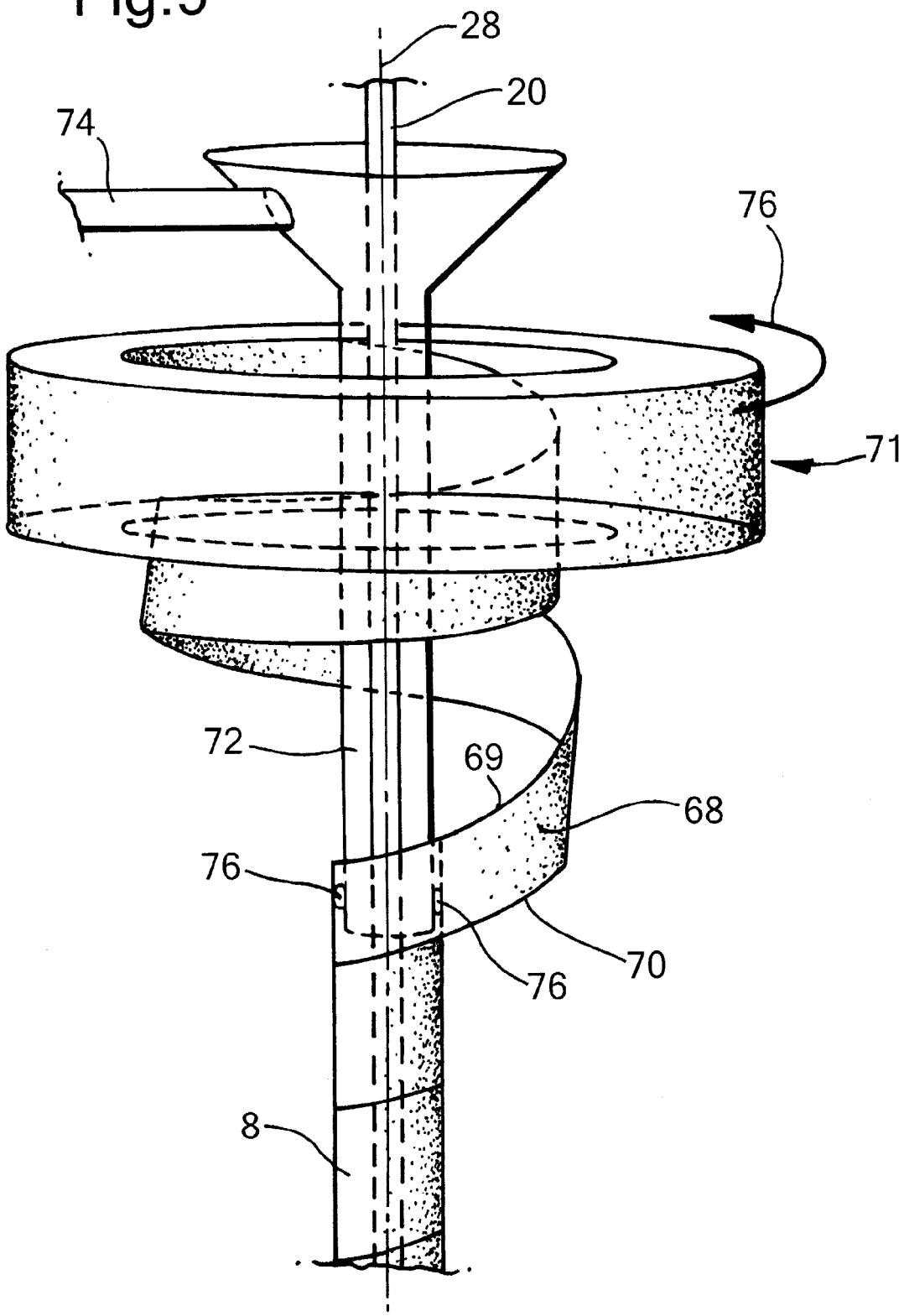
FIG. 9 schematically shows a fifth embodiment of an upper portion of the system of FIG. 1.

FIG. 9 shows a fifth embodiment of an upper portion of the system of FIG. 1, whereby unexpanded liner section 8 is at its upper end extended with a helically wound metal strip 68 having parallel edges 69, 70. The metal strip 68 is unreeled from a reel 71 substantially concentrically arranged around a fluid discharge conduit 72 for discharging drilling fluid from the annular space formed between the drill string 20 and the unexpanded liner section 8. The fluid discharge conduit 72 is provided with a side-outlet 74 and extends substantially concentrically into the unexpanded liner section 8 in a manner allowing the fluid discharge conduit 72 to slide in axial direction relative to the unexpanded liner section 8. An annular seal 76 is provided to seal the fluid discharge conduit 72 to the upper portion of unexpanded liner section 8.

During normal operation a lower end portion of the liner 4 is initially everted, that is, the lower portion is bent radially outward and in axially reverse direction. The U-shaped lower section 11 and the expanded liner section 10 are thereby initiated. Subsequently, the short length of expanded liner section 10 that has been formed is anchored to the wellbore wall by any suitable anchoring means. Depending on the geometry and/or material properties of the liner 4, the expanded liner section 10 alternatively can become anchored to the wellbore wall automatically due to friction between the expanded liner section 10 and the wellbore wall 14.

The unexpanded liner section 8 is then gradually moved downward by application of a sufficiently large downward force thereto, whereby the unexpanded liner section 8 becomes progressively everted in the bending zone 12. In this manner the unexpanded liner section 8 is progressively transformed into the expanded liner section 10. The bending zone 12 moves in downward direction during the eversion process, at approximately half the speed of the unexpanded liner section 8.

If desired, the diameter and/or wall thickness of the liner 4 can be selected such that the expanded liner section 10 becomes pressed against the wellbore wall 14 as a result of the eversion process so as to form a seal against the wellbore wall 14 and/or to stabilize the wellbore wall.

Since the length, and hence the weight, of the unexpanded liner section 8 gradually increases, the magnitude of the downward force can be gradually lowered in correspondence with the increasing weight of liner section 8. As the weight increases, the downward force eventually may need to be replaced by an upward force to prevent buckling of liner section 8.

Simultaneously with downward movement of the unexpanded liner section 8 into the wellbore, the drill string 20 is operated to rotate the drill bit 22 and thereby deepen the wellbore 1 by further drilling. The drill string 20 thereby gradually moves downward into the wellbore 1. The unexpanded liner section 8 is moved downward in a controlled manner and at substantially the same speed as the drill string 20, so that it is ensured that the bending zone 12 remains at a short distance above the drill bit 22. Controlled lowering of the unexpanded liner section 8 can be achieved, for example, by controlling the downward force, or upward force, referred to hereinbefore. Suitably, the unexpanded liner section 8 is supported by the drill string 20, for example by bearing means (not shown) connected to the drill string, which supports the U-shaped lower section 11. In that case the upward force is suitably applied to the drill string 20, and then transmitted to the unexpanded liner section 8 through the bearing means. Furthermore, the weight of the unexpanded liner section 8 can be transferred to the drill string by the bearing means, to provide a thrust force to the drill bit 22.

The unexpanded liner section 8 is at its upper end extended in correspondence with said downward movement, in the manner described hereinafter.

With regard to the first embodiment of the upper portion (FIGS. 2, 3), the wall sections 34, 36, 38 are moved in radial direction towards the central longitudinal axis 28 so as to be applied around the drill string 20, and then to be assembled to form extended upper portion 40. The wall sections are welded to each other and to the unexpanded liner section 8, whereby the first wall section 34 is welded to edge 30 and the second wall section 36 is welded to the upper end of the first wall section 34. The third wall section 38 is welded to edge 32, and overlaps in axial direction with the first and second wall sections 34, 36.

With regard to the second embodiment of the upper portion (FIGS. 4, 5), the wall sections 46, 48, 50 are moved in radial direction towards the central longitudinal axis 28 so as to be applied around the drill string 20, and then to be assembled to form extended upper portion 52. The wall sections are welded to each other and to the unexpanded liner section 8, whereby primary wall section 46 is welded to edge 42 and secondary wall section 48 is welded to the upper end of the primary wall section 46. The tertiary wall section 50 is welded to edge 44, and overlaps in axial direction with the wall sections 46, 48.

With regard to the third embodiment of the upper portion (FIGS. 6, 7), the extension member 54 is moved in radial direction towards the central longitudinal axis 28 whereby the drill string 20 passes through transverse opening 56 (FIG. 4). The extension member 54 is then bent around the drill string 20 until the edges 58, 59 are in abutment. In a next step the edges 58, 59 are welded to each other, and the extension member 54 is welded to the upper edge 56 of unexpanded liner section 8 (FIG. 7).

With regard to the fourth embodiment of the upper portion (FIGS. 8A-C), the metal strip 64 is helically wound around the drill string 20 whereafter the adjoining edges 65, 66 of adjacent windings are welded together so as to initially form extended tubular portion 62 (FIG. 8A). In a next step the extended tubular portion 62 is cut in a lower plane 67*a* and an upper plane 67*b*, both being substantially perpendicular to the central longitudinal axis 28 (FIG. 8B). The lower edge of extended tubular portion 62 is then welded to the upper edge of unexpanded liner section 8 (FIG. 8C).

With regard to the fifth embodiment of the upper portion (FIG. 9), the metal strip 68 is unreeled from the inside of reel 71 and simultaneously wound around the drill string 20 in a helical arrangement. To achieve this, the reel 71 is rotated around central longitudinal axis 28, in the direction of arrow 76. The adjoining edges 69, 70 of adjacent windings are then welded together. The fluid discharge conduit 72 is held stationary during downward movement of the unexpanded liner section 8, whereby the annular seal 76 slides along the inner surface of unexpanded liner section 8.

With the method described above, it is achieved that the unexpanded liner section 8 is extended at its upper end while access to the interior of unexpanded liner section 8 via its upper end is maintained. Thus, there is no need to remove or disconnect the drill string 20 from the wellbore during extension of the unexpanded liner section 8 at its upper end.

Moreover, with the first and second embodiments (FIGS. 2-5) it is achieved that each weld that extends in circumferential direction, such as the weld between wall section 34 and wall section 36, extends only a portion of the circumference, i.e. not along the full circumference. This has the advantage that, in case such circumferential weld is damaged during the eversion process, the damaged weld does not extend the full circumference of the unexpanded liner section 8. An additional advantage of the second embodiment (FIGS. 4, 5) is that all welds extend either axially or inclined relative to the central longitudinal axis. Any risk of propagation of a damaged weld in circumferential direction during the eversion process is thereby further reduced.

As drilling proceeds, the unexpanded liner section is further extended at its upper by connecting additional wall sections in similar manner.

When it is required to retrieve the drill string 20 to surface, for example when the drill bit 26 is to be replaced or when drilling of the wellbore 1 is complete, the reamer section 26 brought to its radially retracted mode. Subsequently the drill string 20 is retrieved through the unexpanded liner section 8 to surface.

With the wellbore system of the invention, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to a heaving tendency of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface.

In case the length of unexpanded liner section is left in the wellbore, there are several options for completing the wellbore. These are, for example, as outlined below.

A) A fluid, for example brine, is pumped into the annulus between the unexpanded and expanded liner sections so as to pressurise the annulus and increase the collapse resistance of the expanded liner section. Optionally one or more holes are provided in the U-shaped lower section to allow the pumped fluid to be circulated.

B) A heavy fluid is pumped into the annulus so as to support the expanded liner section and increase its collapse resistance.

C) Cement is pumped into the annulus in order to create, after hardening of the cement, a solid body between the unexpanded liner section and the expanded liner section, whereby the cement may expand upon hardening.

D) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, suitably a friction reducing layer, such as a Teflon layer, is applied between the unexpanded and expanded liner sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described), the expanded liner section can be expanded against the inner surface of another tubular element already present in the wellbore.

The invention claimed is:

1. A method of radially expanding a tubular element in a wellbore formed in an earth formation, the method comprising:

arranging the tubular element in the wellbore such that a lower end portion of the wall of the tubular element extends radially outward and in an axially reverse direction so as to define an expanded tubular section extending around a remaining tubular section of the tubular element;

axially extending the expanded tubular section by moving the remaining tubular section a selected distance downward relative to the expanded tubular section so that said lower end portion of the wall bends radially outward and in an axially reverse direction; and axially extending the remaining tubular section at an upper end thereof with an extended tubular portion of a length at least equal to said distance of downward movement of the remaining tubular section, wherein the extended tubular portion is formed from first and second wall sections axially displaced from each other, and a third wall section axially overlapping with said first and second wall sections;

wherein a conduit extends into the remaining tubular section; and wherein the extended tubular portion is assembled around said conduit.

2. The method of claim 1 wherein said first and second wall sections are comprised in a primary row of wall sections, and said third wall section is comprised in a secondary row of wall sections, said rows being staggered in axial direction relative to each other.

3. The method of claim 1 wherein said first and second wall sections are interconnected at a connection extending inclined relative to a central longitudinal axis of the remaining tubular section.

4. The method of claim 1 wherein said conduit is a drill string arranged for further drilling of the wellbore.

5. The method of claim 4, wherein the drill string is operated to further drill the wellbore, and wherein the remaining tubular section and the drill string are simultaneously lowered through the wellbore.

6. The method of claim 1 wherein said extended tubular portion is formed from a single wall section having a transverse opening for passage of the conduit therethrough.

7. The method of claim 1 wherein the wall of the tubular element includes a material susceptible of plastic deformation during the bending process so that the expanded tubular section retains an expanded shape as a result of said plastic deformation.

8. The method of claim 1 wherein the remaining tubular section is subjected to an axially compressive force inducing said downward movement of the remaining tubular section.

9. The method of claim 8, wherein said axially compressive force is at least partly due to the weight of the remaining tubular section.

10. A method of radially expanding a tubular element in a wellbore formed in and earth formation, the method comprising:

arranging the tubular element in the wellbore such that a lower end portion of the wall of the tubular element extends radially outward and in an axially reverse direction so as to define an expanded tubular section extending around a remaining tubular section of the tubular element;

axially extending the expanded tubular section by moving the remaining tubular section a selected distance downward relative to the expanded tubular section so that said lower end portion of the wall bends radially outward and in an axially reverse direction; and axially extending the remaining tubular section at an upper end thereof with an extended tubular portion of a length at least equal to said distance of downward movement of the remaining tubular section;

wherein a body of fluid is located in the remaining tubular section, and wherein a fluid conduit extends from the body of fluid to a location above the remaining tubular section, the method further comprising moving the fluid conduit upwardly relative to the remaining tubular section in correspondence with axially extending the remaining tubular section at said upper end.

11. The method of claim 10 wherein said conduit is a drill string arranged for further drilling of the wellbore.

12. The method of claim 11, wherein the drill string is operated to further drill the wellbore, and wherein the remaining tubular section and the drill string are simultaneously lowered through the wellbore.

13. The method of claim 10 wherein said extended tubular portion is formed from a single wall section having a transverse opening for passage of the conduit therethrough.

14. The method of claim 10 wherein the wall of the tubular element includes a material susceptible of plastic deformation during the bending process so that the expanded tubular section retains an expanded shape as a result of said plastic deformation.

15. The method of claim 10 wherein the remaining tubular section is subjected to an axially compressive force inducing said downward movement of the remaining tubular section.

16. The method of claim 15, wherein said axially compressive force is at least partly due to the weight of the remaining tubular section.

* * * * *